US005809751A

United States Patent [19]

Braibanti

[11] Patent Number: 5,809,751

[45] Date of Patent: Sep. 22, 1998

[54] MACHINE FOR AUTOMATICALLY PACKAGING PASTA STRIPS OF WIDE FLAT TYPE, IN PARTICULAR PASTA KNOWN AS LASAGNE

[75] Inventor: Ennio Braibanti, Milan, Italy

[73] Assignee: Braibanti Golfetto S.p.A., Padua, Italy

[21] Appl. No.: 845,137

[22] Filed: Apr. 21, 1997

[30] Foreign Application Priority Data

Apr. 22, 1996 [IT] Italy ..... MI96A0779

[51] Int. Cl.[6] ..... B65B 5/06

[52] U.S. Cl. ..... 53/543; 53/202; 53/252; 53/247

[58] Field of Search ..... 53/202, 247, 506, 53/529, 542, 168, 252, 56, 55, 77; 198/448, 449, 450

[56] References Cited

U.S. PATENT DOCUMENTS

| | | | |
|---|---|---|---|
| 2,936,557 | 5/1960 | Fay | 53/542 |
| 3,370,549 | 2/1968 | Livingston | 53/252 |
| 3,570,209 | 3/1971 | Salwasser | 53/77 |
| 3,678,649 | 7/1972 | Clancy . | |
| 4,067,172 | 1/1978 | Paules | 53/53 |
| 4,179,865 | 12/1979 | Pellaton | 53/435 |
| 4,215,774 | 8/1980 | Manservisi | 198/444 |
| 4,539,795 | 9/1985 | Wilkinson | 53/542 |
| 4,594,066 | 6/1986 | Graham | 425/151 |
| 4,756,141 | 7/1988 | Hirsch | 53/438 |
| 4,769,975 | 9/1988 | Fava | 53/516 |
| 4,982,556 | 1/1991 | Tisma | 53/506 |
| 5,184,712 | 2/1993 | Leypold | 198/449 |

FOREIGN PATENT DOCUMENTS

| | | |
|---|---|---|
| 0 132 417 | 1/1985 | European Pat. Off. . |
| 23 35 026 | 1/1975 | Germany . |
| 1 158 038 | 7/1969 | United Kingdom . |

*Primary Examiner*—John Sipos
*Assistant Examiner*—Jim Calve
*Attorney, Agent, or Firm*—Oblon, Spivak, McClelland, Maier & Neustadt, P.C.

[57] ABSTRACT

A machine for automatically packaging pasta strips of wide flat type, in particular pasta known as lasagne, having at least two matching conveyors provided with a plurality of containing elements, which carry stacks of pasta strips from a horizontal conveying position to a halted discharging position rotated through 90°, adjacent transfer devices being provided to insert the reconstituted stacks into packaging containers carried into a halted position in succession by a further transporting device, the conveyors and transporting device being motorized in mutual stepwise synchronism.

15 Claims, 4 Drawing Sheets

MACHINE FOR AUTOMATICALLY PACKAGING PASTA STRIPS OF WIDE FLAT TYPE, IN PARTICULAR PASTA KNOWN AS LASAGNE

BACKGROUND OF THE INVENTION

1. Field of the Invention

This invention relates to a machine for automatically packaging pasta strips of wide flat type, in particular pasta known as lasagne.

2. Discussion of the Background

The format of pasta known as "lasagne" is well known, this consisting of pasta sheets or strips, normally packaged in stacks of superposed pieces.

The dimensions of these sheets or strips vary, and one variety of them also has curled edges. This is known as curly lasagne or "American lasagne" because of its popularity there. In some production methods the pasta sheets or strips, hereinafter known only as lasagne strips, are deposited across conveying tubes or the like after being produced by an appropriate extruder, and are then transferred into drying plants. After drying, the lasagne strips, suitably cut to size, are ready for insertion into packaging containers, in which they are stacked in the desired number.

This is the most delicate stage of the production process because of the fragility of the product, enhanced by the specific format, to the extent that most of the known machines for their packaging are semi-automatic. In this respect, in these machines the lasagne strips are transferred into the packaging container manually, with considerable personnel cost and a relative considerable volume of rejects.

SUMMARY OF THE INVENTION

An object of the present invention is to provide a machine or apparatus which receives the lasagne strips from the cutting machine and then automatically inserts them into the packaging containers.

A further object of the present invention is to attain the aforesaid object by a highly productive machine or apparatus which requires the least possible control and intervention by personnel. These and further objects are attained according to the present invention by a machine for automatically packaging pasta strips of flat wide type, in particular pasta known as lasagne, comprising at least two matching conveyor means provided with a plurality of containing elements, which carry stacks of pasta strips from a horizontal conveying position to a halted discharging position rotated through 90°, adjacent transfer devices being provided to insert said reconstituted stacks into packaging containers carried into a halted position in succession by a further transporting means, said conveyor means and transporting means being motorized in mutual stepwise synchronism.

BRIEF DESCRIPTION OF THE DRAWINGS

Further general characteristics and advantages of the machine according to the present invention will be more apparent from the description thereof given hereinafter by way of non-limiting example with reference to the accompanying drawings, in which.

DESCRIPTION OF THE PREFERRED EMBODIMENT

Figure 1:
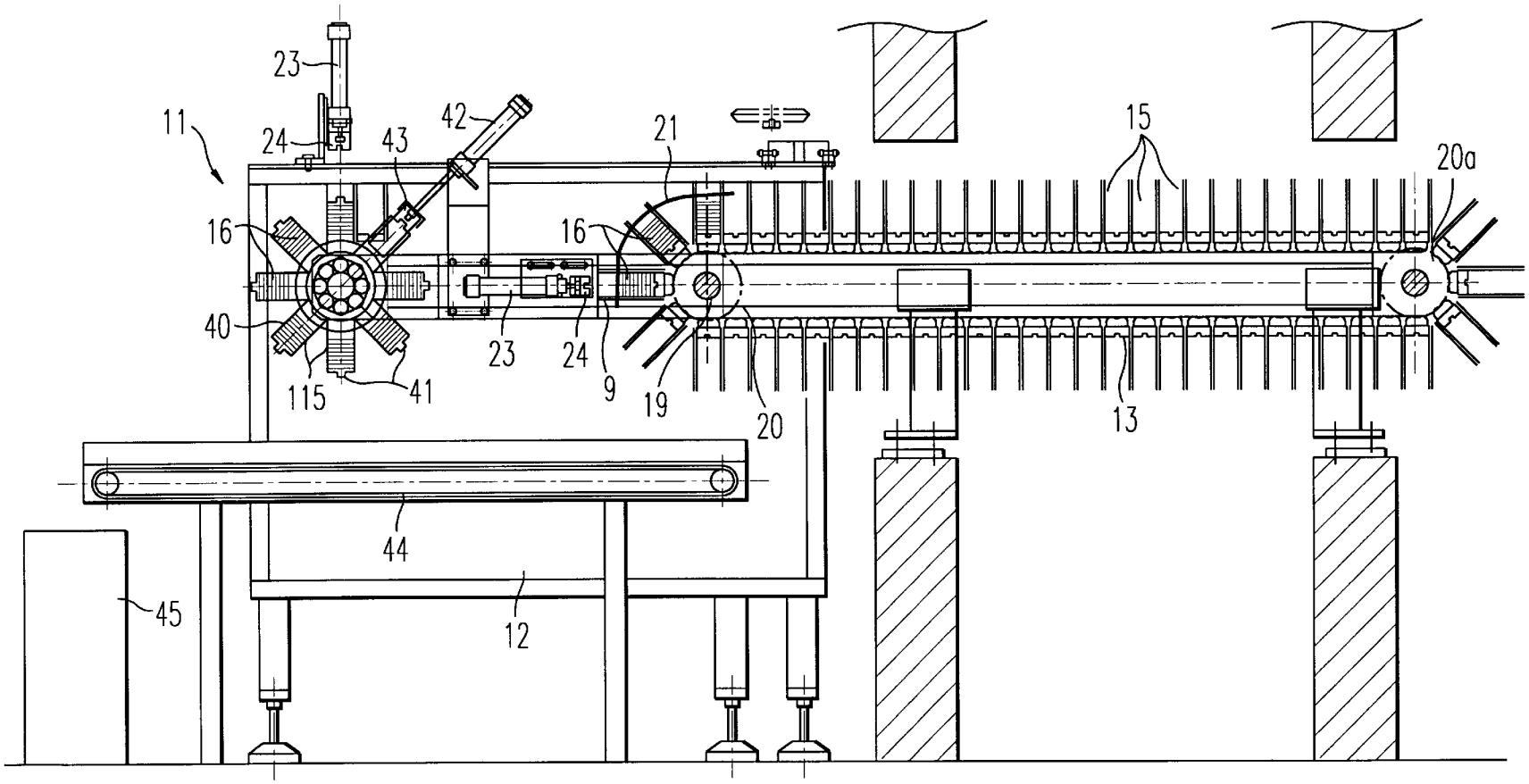
FIG. 1 is a schematic longitudinal elevation of the automatic lasagne packaging machine according to the present invention.
Figure 2:
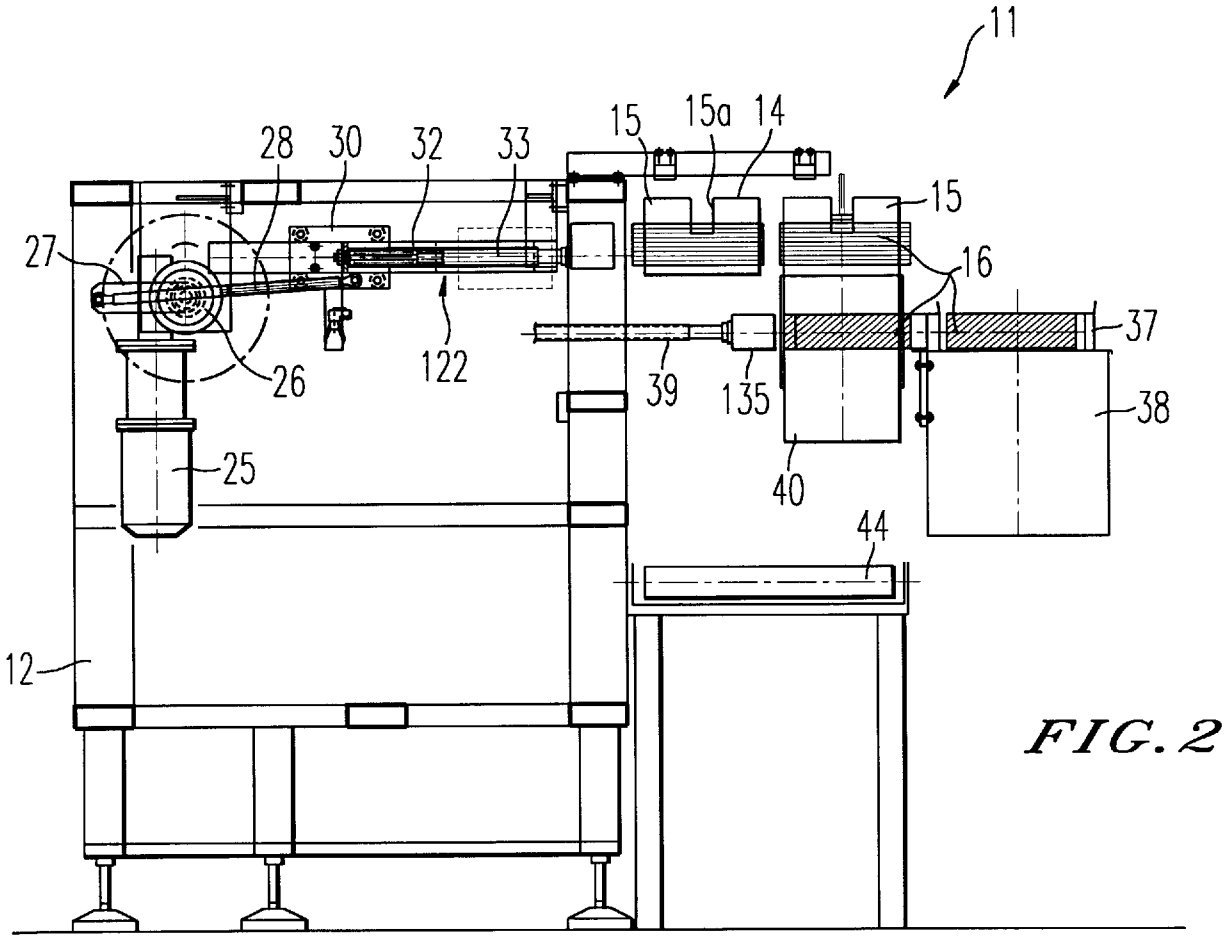
FIG. 2 is an elevational cross-section through the machine of FIG. 1 taken at the final transfer station.
Figure 3:
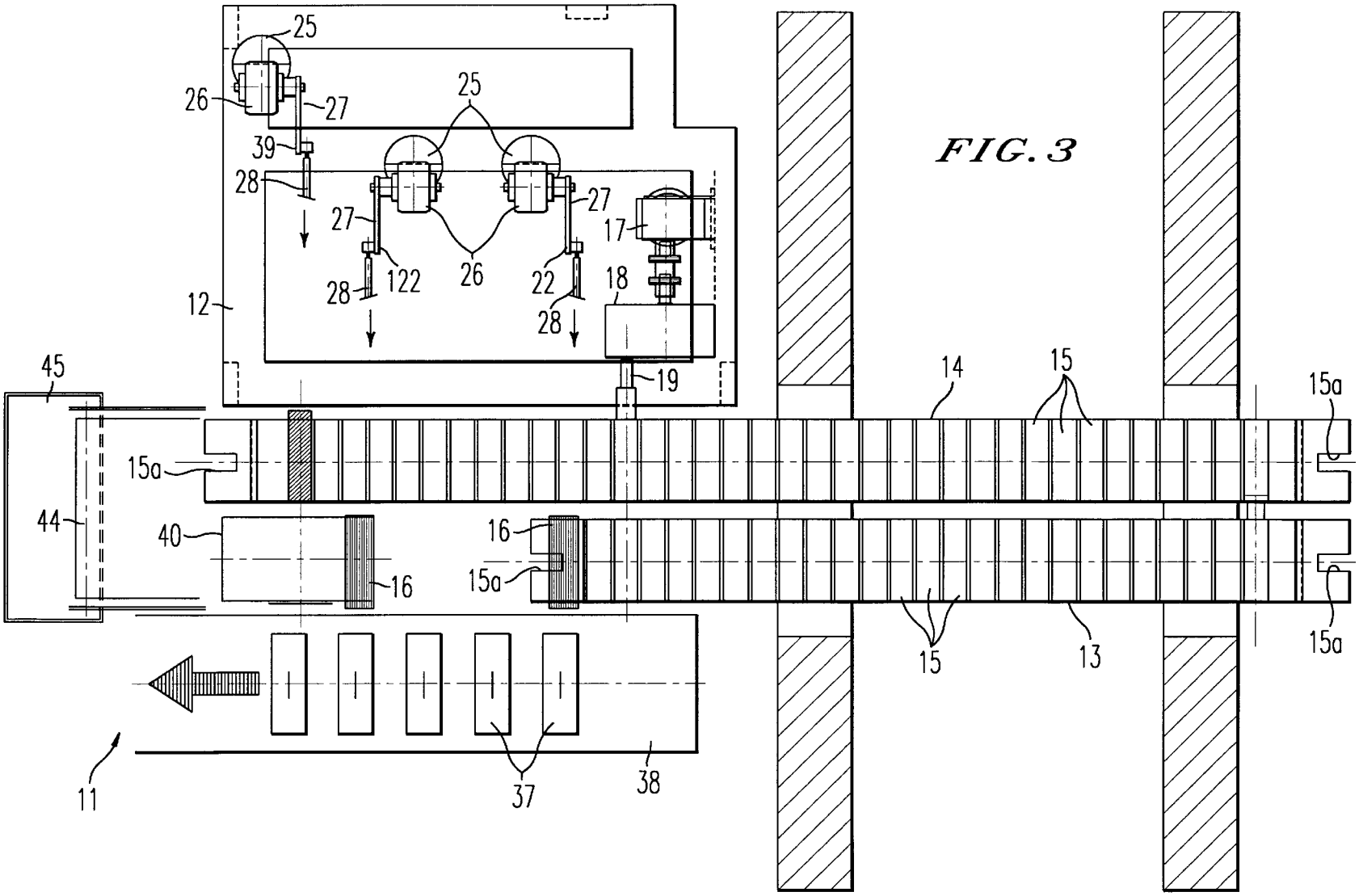
FIG. 3 is a partial plan view from above of the machine of FIG. 1 and of the parallel transporting line for the packaging.

With reference to the figures, a machine for automatically packaging pasta strips of wide flat type, in particular of pasta known as "lasagne" according to the invention is indicated overall by 11.

The machine 11 comprises substantially a general frame 12 on which there is arranged a transporting member, which in the example consists of two endless chains 13 and 14 positioned side by side and each provided with a series of containing elements or containers 15. The containing elements 15 are open upwardly and in the direction in which they are side by side, in accordance with a U cross-section, and are able to receive a desired quantity of lasagne strips in a horizontal position, stacked one on another, the strips being indicated schematically by 16 and originating from cutting units, not shown in the figures.

The chains 13 and 14 are driven synchronously by a geared motor 17, of known type, operating an intermittent motion device of cam type 18, which by virtue of the particular cam contour provides the stepping movement of the containing elements 15. A common shaft, indicated schematically by 19, moves the two chains 13 and 14 either directly or via respective transmissions, not shown, which operate drive gears or sprocket wheels 20.

A safety device of the torque limiting type, also not shown, is inserted between the intermittent motion device 18 and the relative transporting means 13 and/or 14. In this manner the chains 13 and/or 14 can be disengaged if the geared motor 17 is subjected to excessive force. It is evident that when the force ceases the chains automatically return to step. Such a malfunction is indicated automatically on the control panel by a suitable microswitch, not shown.

The chain 13 carrying the containing elements 15, which contain the lasagne strips 16, advancing along its endless path about the end drive sprocket wheel 20 and driven sprocket wheel 20*a*, enters a curved guide portion 21 which follows the profile of the chain along its drive sprocket wheel 20. The guide portion is located in the recesses 15*a* in the containing elements 15, to maintain the lasagne strips 16 in place within the containing elements 15 as far as a subsequent position 9, rotated through 90° from the essentially horizontal starting position.

Figure 4:
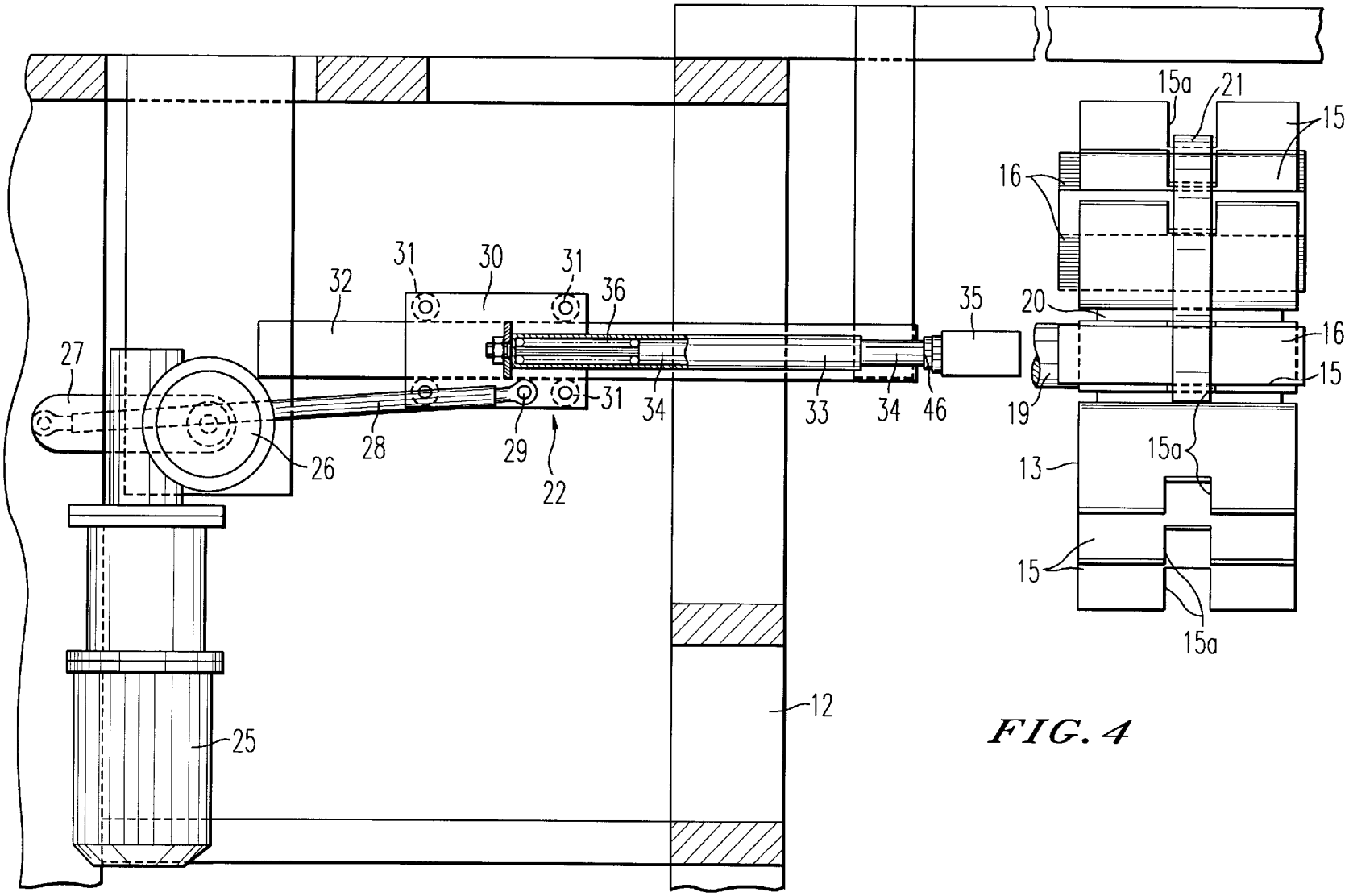
FIG. 4 is an enlarged cross-section through the first transfer station of the machine of FIG. 1, showing only one chain.

It is precisely in this position that the now vertical lasagne strips 16 contained in the respective containing element 15 and rotated through 90° from the horizontal starting position, arrive at a first transfer station indicated overall by 22. The chain 13 halts in this position, and the lasagne strips 16 contained in the containing element 15 rotated through 90° are compacted by a compactor device. This is specifically achieved by a press 24, operated by a pneumatic device 23, which penetrates into the upper open part of the containing element 15 of U cross-section. At this point the transfer station 22, shown in detail in FIG. 4, comes into operation, it being composed essentially of a geared motor 25 provided with a brake-clutch unit 26. The unit 26 directly operates a linkage consisting of a drive crank 27 and a relative connecting rod 28 connected to it. To the other end of the connecting rod 28 there is pivoted by a pin 29 a carriage 30, moving with reciprocating movement via its wheels 31, which run on a track 32 fixed to the frame 12.

A pusher element 35 is fixed to the carriage 30 by an arm formed from two coaxial tubes, of which one 33 is fixed and the other 34 is slidable within the first 33. The slidable tube 34 is maintained in position by a compression spring 36 which if the pusher 35 becomes blocked enables the travel of the linkage 27, 28 to go to completion, with subsequent operation of a microswitch 46, which halts the entire machine to prevent breakage or jamming.

The pusher 35, suitably shaped complementary to the interior of the containing elements 15, laterally enters the containing elements 15 with a continuous progressive transverse movement. In this manner the pusher 35 pushes a stack of lasagne strips 16, contained and compacted therein, into respective boxes 37 fed one after another at a predetermined pitch along a single parallel transporting surface 38.

This translational movement attains its maximum speed when the group of lasagne strips 16 already rests on the transporting surface 38 in its respective box 37.

The lasagne strips 16 arranged on the chain 14, which lie at a greater distance from the transporting surface 38 than those on the chain 13, are moved to a subsequent station or halt point 39, where they are again in a horizontal position.

In this second transfer station 39, the structure of which is fairly similar to that already described for the first station 22, the lasagne strips 16 contained in the containing elements 15 of the second chain 14 are transferred to the boxes 37.

More specifically, the lasagne strips 16 are firstly transferred from the containing elements 15 of the second chain 14 to similar containing elements 115 forming part of a rotary drum 40, in which latter elements they are compacted by a vertical compacting device also provided with a press 24 operated by a pneumatic device 23 to penetrate into the upper open part of the containing element 115 of U cross-section.

The rotary drum 40, which by way of suitable known transmissions is operated by the same drive 17, 18, 19 as the chains 13 and 14, consists essentially of eight containing elements or loading compartments 115, also open laterally, which are provided with upper resting elements 41 which maintain the lasagne strips 16 in place during the circular movement of the drum 40.

As the number of lasagne strips 16 in the containing elements 115 varies according to market requirements, the containing elements 115 have said upper resting element 41 movable so that by means of a suitable cam, not shown, provided within the drum 40 it can vary their capacity according to the lasagne strips to be contained. The stepping pitch between one containing element or loading compartment 115 and the next is 45°, a monitoring device being provided to verify the correct repositioning of them in phase with the transfer station 39. This monitoring device consists of an appropriate pneumatic device 42 which, by means of a fork 43, monitors the rotary drum 40 at each step.

The lasagne strips 16 inserted stepwise by the transfer station 39 into the containing element 115 of the drum 40, always in a horizontal position, are rotated through 270° to present themselves in a vertical position to a further transfer station 122, similar to the preceding station 22, where a pusher 135 enters the containing element 115 of the drum 40 laterally and transversely, to urge the stack of lasagne strips 16 into the box 37 on the transporting surface 38 to its side.

A series of photoelectric cells positioned in correspondence with the chains 13 and 14 prior to the transfer stations 22, 39 and 122 ensure that the preset number of lasagne strips 16 are present in each container 37. If this is not the case the pusher elements 35 are halted by a signal, and the relative containing element 15 continues its movement to discharge the lasagne strips 16 onto a conveyor belt 44 and then into a container 45.

In this manner an automatic packaging machine for food products is obtained which is based on simple but effective technology, is highly productive even compared with substantially continuous operability, and is adaptable to any existing production plant. In addition any possible error in the number of lasagne strips to be inserted is hence eliminated, this being automatically determined and being equal in all the packages to be marketed.

I claim:

1. A machine for automatically packaging pasta strips of wide flat type, in particular pasta known as lasagne, comprising:

at least two matching conveyors provided with a plurality of containing elements, which carry stacks of pasta strips from a horizontal conveying position to respective halted discharging positions, at least one of said containing elements is rotated through approximately 90°;

a transporting conveyor adjacent to said at least two conveyors to carry packaging containers:

adjacent transfer devices for removing stacks of pasta from each of said at least two conveyors and inserting said stacks into said packaging containers on said transporting convevor; and a rotary drum provided between one of said at least two conveyors and said transporting conveyor to rotate said stack of pasta strips received from one of said at least two conveyors by approximately 90°;

said at least two conveyors and transporting conveyor being motorized in mutual stepwise synchronism.

2. A machine as claimed in claim 1, wherein:

said adjacent transfer devices comprise first and second adjacent transfer devices respectively adjacent to said at least two matching conveyors;

said first transfer device receiving first stacks from a first one of said at least two matching conveyors; and said second transfer device receiving second stacks from a second one of said at least two matching conveyors, said first stacks being rotated approximately 90° relative to said second stacks.

3. A machine as claimed in claim 1, comprising:

said rotary drum having a plurality of containing elements; and a plurality of adjustable elements respectively attached to said containing elements for selectively adjusting a number of pasta strips in a stack.

4. A machine as claimed in claim 1, wherein devices for compacting said stacks of pasta strips in said containing elements are associated with said at least two conveyors.

5. A machine as claimed in claim 1, comprising said transfer devices are positioned in transfer stations and comprise linkages arranged to transmit to pusher discharge elements a horizontal reciprocating movement with a progressive thrust on said stacks of pasta strips.

6. A machine as claimed in claim 5, wherein safety switches are associated with said pusher discharge elements to halt the machine if one of said pusher discharge elements becomes blocked, having eliminated said blockage it being possible to return said machine to operation.

7. A machine as claimed in claim 5 or 6, wherein with each of said linkages of said pusher elements there is associated a tube slidable within another coaxial fixed tube and maintained in its extended position by an appropriate compression spring, a safety switch being provided in case of over-stressing of said spring.

8. A machine as claimed in claim 1, wherein the stacks of pasta strips of a longer of said at least two conveyors are positioned identically to the stacks of pasta strips of the shorter other of said at least two conveyors, said rotary drum receiving said stacks of pasta strips of said longer of said at least two conveyors.

9. A machine as claimed in claim 8, wherein said rotary drum is provided with containing elements, said containing elements being open transverse to the direction of movement of one of said at least two conveyors.

10. A machine as claimed in claim 8 or 9, wherein said containing elements are provided with a movable resting element able to contain a stack of lasagne strips of predetermined number.

11. A machine as claimed in claim 10, wherein a number of strips in said stack contained in each of said containing elements is adjusted by positioning said movable resting element by said rotary drum.

12. A machine as claimed in claim 9, wherein radial position of said containing elements of said rotary drum is monitored by a pneumatic monitoring contact device.

13. A machine as claimed in claim 8, wherein one of said transfer devices is positioned in correspondence with said drum.

14. A machine as claimed in claim 1, wherein said at least two conveyors consist of endless chains passing about relative end sprocket wheels and carrying said containing elements.

15. A machine as claimed in claim 8, wherein:

said rotary drum receives a stack from said longer of said at least two conveyors rotates said stacks to be oriented approximately the same as stacks transferred to the shorter of said at least two matching conveyors; and said adjacent transfer devices insert said stacks into packaging containers located on a single transporting conveyor.

* * * * *